US005443375A

United States Patent [19]

Cureton et al.

[11] Patent Number: 5,443,375

[45] Date of Patent: Aug. 22, 1995

[54] TROCHOIDAL PISTON CONSTRUCTION

[75] Inventors: George K. Cureton, Croydon; Mark S. Profaca, Kew, both of Australia

[73] Assignee: Scalzo Automotive Research Limited, Victoria, Australia

[21] Appl. No.: 248,427

[22] Filed: May 24, 1994

[30] Foreign Application Priority Data

May 24, 1993 [AU] Australia ..... PL8942

[51] Int. Cl.[6] ..... F01C 1/10

[52] U.S. Cl. ..... 418/61.3; 403/265

[58] Field of Search ..... 418/61.1, 61.2, 61.3; 403/265, 267, 269, 273

[56] References Cited

U.S. PATENT DOCUMENTS

| | | | |
|---|---|---|---|
| 2,935,053 | 5/1960 | Brueder . | |
| 2,949,905 | 8/1960 | Brueder . | |
| 2,988,065 | 6/1961 | Wankel et al. . | |
| 2,988,070 | 6/1961 | Brueder . | |
| 3,103,208 | 9/1963 | Price et al. . | |
| 3,111,884 | 11/1963 | Peras | 418/61.3 |
| 3,131,379 | 4/1964 | Holt . | |
| 3,154,061 | 10/1964 | Biabaud . | |
| 3,253,582 | 5/1966 | Ortlieb . | |
| 3,266,468 | 8/1966 | Peras . | |
| 3,410,254 | 11/1968 | Huf . | |
| 3,444,852 | 5/1969 | Biabaud . | |
| 3,465,613 | 9/1969 | Biabaud . | |
| 4,826,346 | 5/1989 | Nishiura et al. | 403/267 |
| 4,977,793 | 12/1990 | Husted | 403/267 |
| 5,165,881 | 11/1992 | Wicen | 403/267 |
| 5,295,814 | 3/1994 | Uebel | 418/61.3 |

FOREIGN PATENT DOCUMENTS

| | | |
|---|---|---|
| 1024504 | 3/1966 | United Kingdom . |
| 1042722 | 9/1966 | United Kingdom . |

*Primary Examiner*—Richard A. Bertsch
*Assistant Examiner*—Charles G. Freay
*Attorney, Agent, or Firm*—Merchant, Gould, Smith, Edell, Welter & Schmidt

[57] ABSTRACT

A rotor assembly for a multi-lobed trochoidal rotary engine, said assembly including a flat trochoid shape rotor which defines a bore by which the rotor is rotatably mounted on the crankpin of a crankshaft, and a steel hub, secured in the bore so as to project beyond one of the opposite side faces of the rotor, characterized in that the hub is mechanically inter-locked with the rotor in an arrangement which allows for differences in thermal expansion co-efficients of the rotor and hub, while substantially preventing relative rotation between the rotor and hub and substantially preventing radial separation of the rotor and hub.

4 Claims, 2 Drawing Sheets

TROCHOIDAL PISTON CONSTRUCTION

BACKGROUND OF THE INVENTION

This invention relates to the construction of a rotor in a trochoidal rotary internal combustion engine of the spark ignition and compression ignition types.

Rotary piston engines to which the present invention relate have a multilobed piston member (hereinafter referred to as a "rotor") rotatably mounted on a crankpin of a crankshaft, with the crankshaft rotatably mounted in a housing. The multi-lobed rotor has the shape of a trochoid or of a curve inside and parallel to a trochoid, while the housing has an inner surface shape corresponding respectively to the outer enclosing curve, or outer envelope, of the trochoid or of the inside parallel curve; these alternatives hereinafter being encompassed by reference to "trochoid" or the "outer enclosing curve, or envelope" thereof. Rotational phasing of the rotor relative to the shaft and the housing is ensured by an external gear which is fixed to the rotor and which meshes with an internal gear fixed to the housing. The trochoid has at least two lobes and theoretically it can have any greater number of lobes. The number of lobes determines the gear ratio required for phasing and also the number of working chambers in the housing; the number of such chambers being equal to the number of lobes plus one. Thus a family of trochoidal piston rotary engines exists. The present invention is particularly relevant to two lobe trochoid rotary piston engines with three working chambers, and the following description largely is directed to engines having a single two lobe, trochoid shaped rotor. However, the invention extends to engines having more than one rotor and to engines having at least one rotor with three or more lobes.

It is desirable for an engine of this type to have a lightweight rotor to avoid excessive load on a rotor bearing by which the rotor is rotatable on the crankpin, caused by high inertia forces particularly at high speed. For high speed engines it is normal to construct the rotor from an aluminium or magnesium alloy, although it also can be constructed of graphite. However the rotor must be mated to the external gear, with the latter being an external case hardened steel gear for stabilisation purposes, which necessitates the use of a steel hub inserted into the rotor. This steel hub also provides support for the rotor bearing.

Due to different temperature expansion coefficients of the steel hub and the material of which the rotor is constructed, the rotor expands away from the hub. However, it is essential that the hub be locked with the rotor in a manner that prevents this separation, both radially and circumferentially, without risk of distorting the hub or rotor bearing. The present invention provides an arrangement for achieving this.

SUMMARY OF THE INVENTION

The present invention provides an assembly, including a trochoidal shaped rotor which defines a bore by which the rotor is rotatably mountable on the crankpin of a crankshaft. The assembly further includes a steel hub, secured in the bore so as to project beyond one of the opposite side faces of the rotor. In the assembly, the hub is mechanically inter-locked with the rotor in an arrangement which allows for differences in thermal expansion co-efficients of the rotor and hub, while substantially preventing relative rotation between the rotor and hub and radial separation of the rotor and hub.

In a first aspect of the invention, the hub defines an outer peripheral surface which is provided with a circumferentially extending, external keyway. The rotor is formed on and around the keyway such that the material of which the rotor is formed is inter-locked with the keyway and provides the required securement between the rotor and hub. This first aspect of the invention principally is applicable to a rotor formed of a suitable metal, such as of an aluminium or magnesium alloy, with the rotor being cast around the keyway.

The hub may comprise a sleeve with which the keyway is integrally formed, such as by machining or casting. However, the hub preferably comprises a steel sleeve and a separate annular, steel connector in which the sleeve is received and secured such as by welding.

The keyway may include at least two axially spaced, circumferential ribs or rings which define at least one radially outwardly open slot therebetween. Preferably, the ribs or rings are configured so that the slots are of dove-tail form, whereby the material of the rotor is mechanically inter-locked therewith on forming the rotor.

The keyway alternatively may comprise a plurality of angularly spaced, axially extending keys or straps with which the material of the rotor is mechanically interlocked on forming the rotor. Such keys or straps are such that, on forming the rotor, the material of which the rotor is formed extends radially behind the keys or straps in a manner such that the formed rotor is restrained against relative rotation on the hub and against radial separation from the hub.

In preferred arrangements of the first aspect of the invention, the keyway is defined by a combination of such ribs or rings and such keys or straps. In one such preferred arrangement, angularly spaced keys are provided in the or each slot. In another such preferred arrangement, the straps are secured over the or each slot, such as by welding to successive ribs or rings.

In a second form of the invention, the rotor is preformed, rather than formed on and around the keyway. In the second aspect, the rotor defines around its bore at least one set of internal splines which mate with a set of external splines of the hub. The arrangement is such that the mating splines prevent relative rotation between the rotor and hub and remain in mating relationship notwithstanding differential thermal expansion of the rotor and hub.

In a preferred arrangement according to the second aspect of the invention, the rotor comprises a main body and, at least over part of at least one side face of the body, a side plate which is secured to the body and defines the internal splines. In that preferred arrangement, the rotor body can be formed of a suitable metal, such as an aluminium or magnesium alloy, or shaped from a suitable grade of block graphite, while the or each side plate may be formed of steel and is secured to the body. The hub preferably is a firm friction fit within a portion of the rotor bore defined by the body, with mating of the respective internal and external splines being radially within that bore portion.

In the assembly of the invention, the hub projects axially beyond one side face of the rotor such that an external gear can be co-axially mounted thereon and secured such as by welding.

BRIEF DESCRIPTION OF THE DRAWINGS

The invention will now be described with reference to the accompanying drawings showing typical embodiments of the invention in which:

FIG. 2 is a partial cross-section, iso-metric exploded view of a second embodiment of the invention;

DETAILED DESCRIPTION OF THE INVENTION

Figure 1:
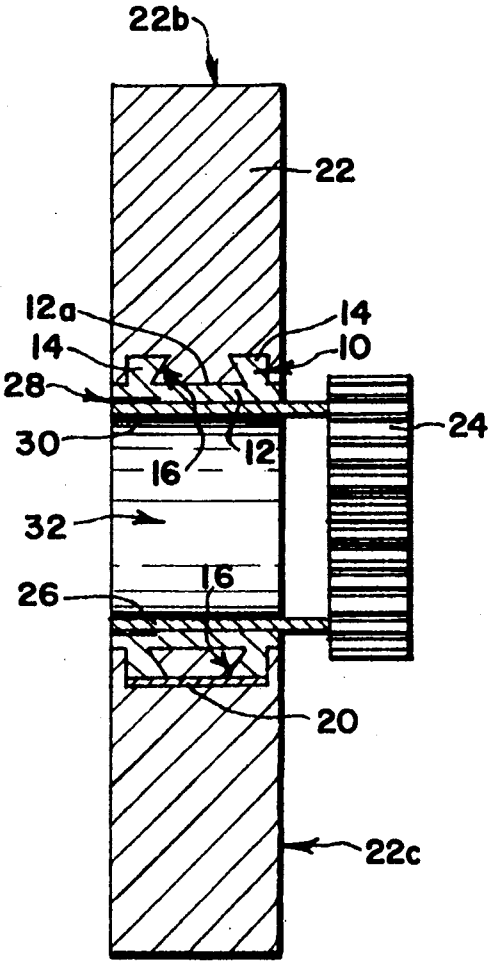
FIG. 1 is a longitudinal cross-section of a first embodiment of a rotor assembly according to the invention.

FIG. 1 shows a rotor assembly comprising a rotor 22, a sleeve 26, a connector 12 and an external gear 24. Connector 12 provides coupling between rotor 22 and sleeve 26 to provide a hub 10 for rotor 22. Sleeve 26, connector 12 and gear 24 are secured in assembly with rotor 22 so as to be coaxial with bore 32 of rotor 22.

Rotor 22 has a peripheral surface 22*b* in the form of a trochoid, or of an outer enclosing curve or envelope of a trochoid. Where of two lobe form, surface 22*b* corresponds to that shown by surface 122*b* of FIG. 3. Rotor 22 is made of aluminium or magnesium alloy. Sleeve 26 is of steel and projects axially of bore 32 of rotor 22, beyond one of opposed side faces 22*c* of rotor Gear 24 also is of steel and is secured, such as by welding, on an end of sleeve 26 which is remote from rotor 22.

Connector 12 is of annular form such that sleeve 26 is receivable therein in an interference fit. Connector 12 also is of steel, such that it can be secured to sleeve 26 by welding, preferably by an electron beam weld provided from the side of gear 24 remote from rotor 22.

Around its outer periphery and integral with connector 12 there are two axially spaced rings 14, each shaped to form a locking member. As shown, a side surface 16 of each ring 14, which faces with the other ring 14, is inclined such that a dove-tail slot 12*a* is defined therebetween.

Connector 12 also includes a plurality of steel straps 20. While only one strap 20 is shown in FIG. 1, the straps 20 are spaced around the outer circumference of connector 12 at uniform angular intervals. Straps 20 are of steel and each extends across slot 12*a*, between rings 14, and is welded at a respective end thereof to the outer surface of each ring 14.

In constructing the rotor assembly of FIG. 1, there first is provided connector 12, with its straps 20 secured. Rotor 22 then is cast on to connector 12 with molten alloy to form rotor 22 filling slot 12*a* around the full circumference of connector 12, and encapsulating the part of each strap 20 bridging slot 12*a*. When cast, rotor 22 therefore effectively is integral with connector 12, and is secured against radial separation therefrom and against relative rotation, despite differences in the respective thermal expansion coefficient of the different metals of connector 12 and rotor 22. The portion of the metal of rotor 22 within slot 12*a* locks rotor 22 in the radial direction, while encapsulation of straps 20 locks rotor 22 against rotation relative to connector 12.

Sleeve 26 can be secured in connector 12 by welding, such as by electron beam weld 28, before or after casting rotor 22. However, it is highly preferable to provide such securement after casting rotor 22. Gear 24 is secured to sleeve 26 at an appropriate stage, such as after casting rotor 22 if sleeve 26 is secured to connector 12 before such casting. When sleeve 26 is secured in connector 12 after rotor 22 has been cast on to the latter, gear 24 can be secured on to sleeve 26 before or after securement of the latter, to connector 12.

As shown, a bearing 30 is fitted within sleeve 26. Bearing 30 is machined to suit the crankpin of an engine crankshaft on which rotor 22 is to be rotatably mounted.

The assembly of FIG. 2 is very similar to that of FIG. 1, and corresponding parts have the same reference numerals. Indeed, the similarity of the respective embodiments of FIGS. 1 and 2 is such that, apart from differences to be detailed, each embodiment can be considered in conjunction with the other to enhance an overall appreciation of each. However, while FIG. 2 provides an exploded view, it is to be appreciated that its rotor 22 again is cast to achieve mechanical interlocking.

Figure 2A:
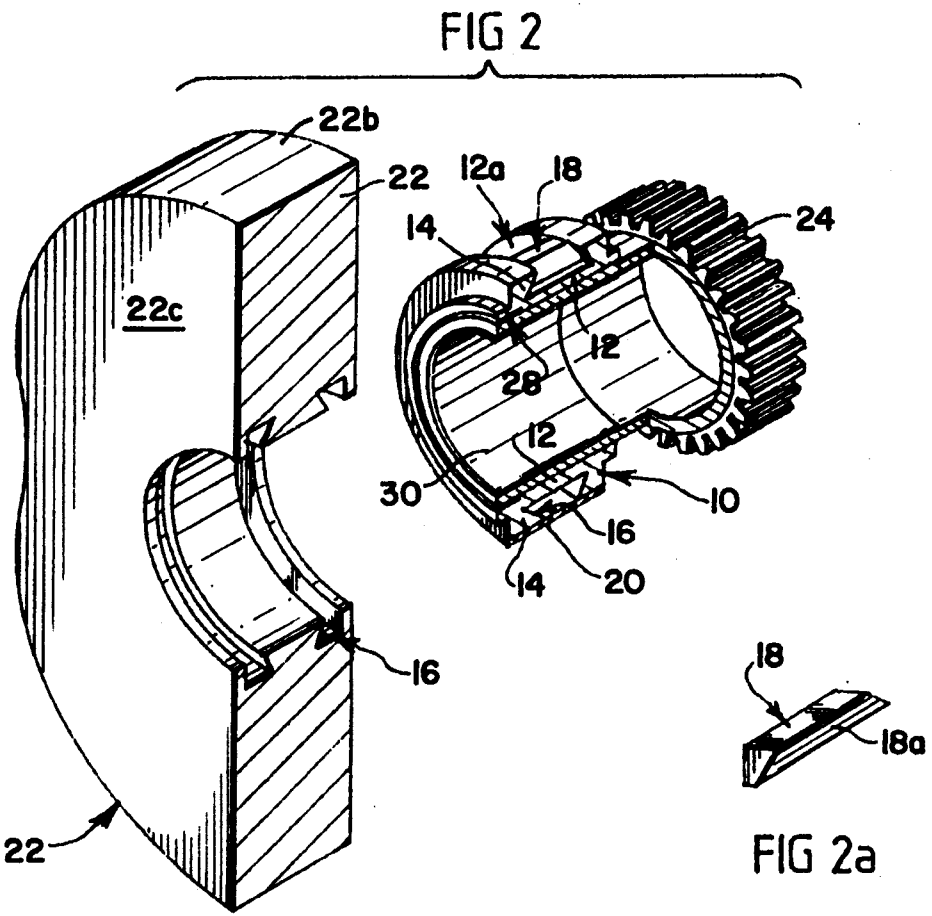
FIG. 2*a* is an enlarged perspective view of a portion of FIG. 2 showing the key 18.

The difference between FIG. 1 and 2 is that FIG. 2 shows an alternative to use of straps 20. In the embodiment of FIG. 2, straps 20 are replaced by keys 18. The overall form of one of keys 18 is shown in FIG. 2*a*. Keys 18 extend axially across and within slot 12*a*. There is a plurality of keys 18 which, as with straps 20, are uniformally angularly spaced. Keys 18 can be formed separately and secured in slot 12*a* by welding, or they can be formed integrally by a suitable casting or machining operation.

Each key 18 has at least one inclined side face 18*a* which, while extending at right angles to surfaces 16 of rings 14, provides a dove-tail connection with rotor 22 on casting the latter. Rings 14 secure rotor 22 radially in relation to connector 12, while keys 18 also secure rotor 22 both radially and circumferentially relative to connector 12.

Figure 4:
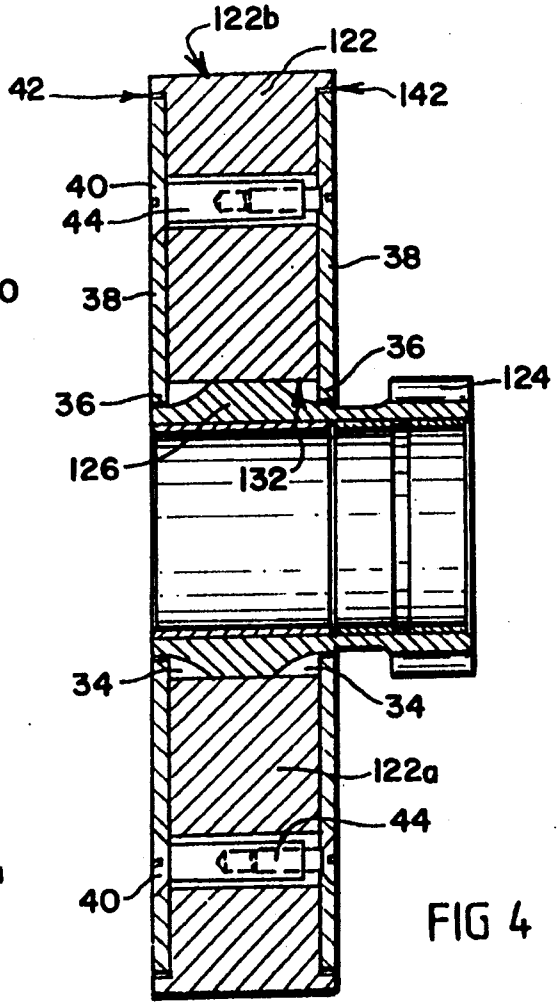
FIG. 4 is a longitudinal cross-section on line III-III of FIG. 3.
Figure 3:
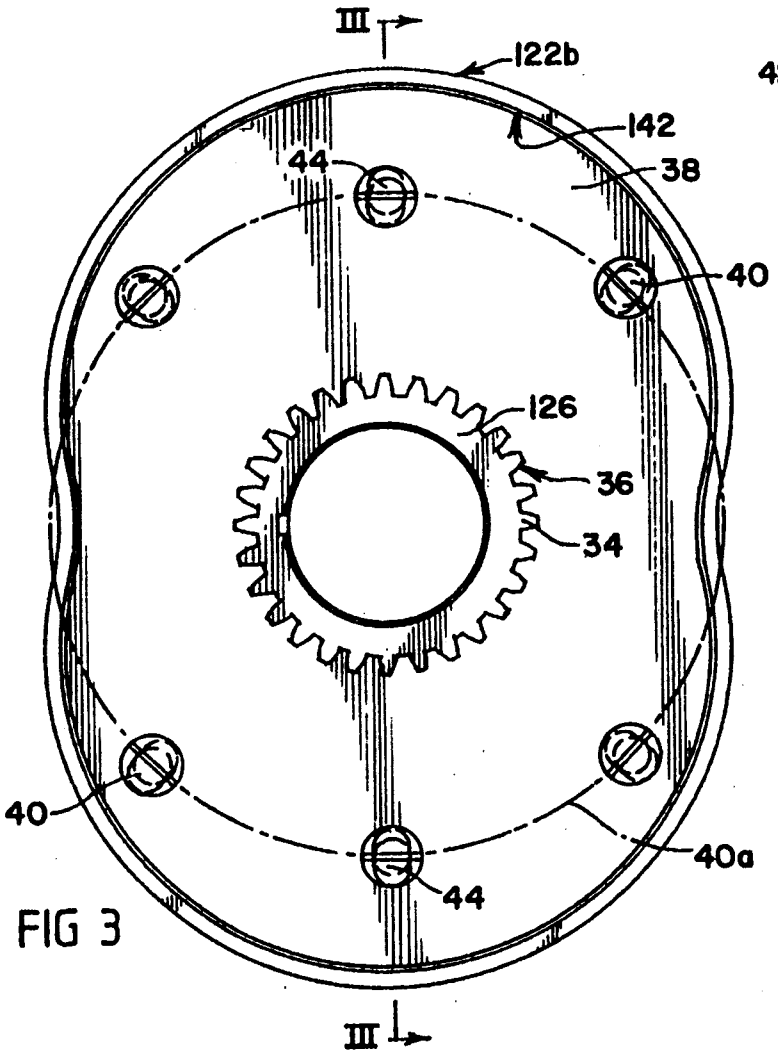
FIG. 3 is a front view of a rotor construction according to a third embodiment of the invention.

The embodiment of FIGS. 3 and 4 differs significantly from that of either of FIGS. 1 and 2. However, corresponding parts are identified by the same reference numeral plus 100.

In FIGS. 3 and 4, rotor 122 differs from rotor 22 of either of FIG. 1 and 2 in that it has a main body portion 122*d* and two side plates 38. At each of its opposed sides, body 122*d* is recessed over a major part of its area radially inwardly of a side seal groove 42. A respective plate 38 occupies the recessed area, with its outer periphery defining the radially inner side of groove 42. Each plate 38 is of annular form and of steel, and is secured to body 122*d* by screws 40 which extend through axial apertures 44 in body 122*d*. As shown, screws 40 are at angular locations on circle 40*a* which is concentric with the axis of bore 132 of rotor 122. At one side face 122*c* of rotor 122, screws 40 are internally threaded, and receive the externally threaded screws at the other face 122*c*.

In FIGS. 3 and 4, sleeve 126 incorporates gear 124 as an integral component thereof. Also, sleeve 126 provides for securement of rotor 122, without the need for provision of a separate component corresponding to connector 12 of each of FIGS. 1 and 2. In the latter regard, the portion of sleeve 126 received in bore 132 of rotor 122, is a neat, interference fit in the part of bore 132 defined by rotor body 122*d*. However, around bore 132, each plate 38 defines internal splines 36 which project radially inwardly beyond the portion of bore 132 defined by rotor body 122*d*. Also, at each end of its extent providing an interference fit in body 122*d*, sleeve 126 has respective external splines 34 which mate with the splines 36 of a respective plate 38.

The radial extent of mating pairs of splines 34 and 36 is such as to more than compensate for the difference in thermal expansion of body 122*d* of rotor 122 and sleeve 126. The arrangement thus accommodates differences in thermal expansion by locking rotor 122 radially with respect to sleeve 126 and preventing relative rotation therebetween. The arrangement is such that body 122*d* of rotor 122 can be made from an aluminium or magnesium alloy, or formed from block graphite.

Finally, it is to be understood that various alterations, modifications and/or additions may be introduced into the constructions and arrangements of parts previously described without departing from the spirit or ambit of the invention.

The claims defining the invention are as follows:

1. A multi-lobed rotor assembly, for a trochoidal rotary engine which includes a crankshaft having a crankpin within a working chamber, said assembly including:

i) a multi-lobed trochoidal rotor which defines a bore, extending between opposite, flat side faces of the rotor, by which the rotor is rotatably mountable on the crankpin of the crankshaft; and ii) a steel hub which is secured in the bore so as to project beyond one of the opposite side faces of the rotor and which provides means by which the rotor is rotatably mountable on the crankpin;

characterized in that a) the rotor is made of a material which has a co-efficient of thermal expansion which is different to the co-efficient of thermal expansion of the steel hub; and b) the hub defines an outer peripheral surface which is provided with a circumferentially extending external keyway and the rotor is formed on and around the keyway such that the material of which the rotor is formed is interlocked with the keyway;

whereby the hub is mechanically inter-locked with the rotor to allow for differences in the thermal expansion co-efficient of the rotor and hub, while substantially preventing relative rotation between the rotor and hub and substantially preventing radial separation of the rotor and hub.

2. A rotor assembly according to claim 1 wherein the keyway includes at least two axially spaced, circumferential rings which define at least one radially outwardly open slot therebetween and the material of the rotor is mechanically inter-locked therewith on forming the rotor.

3. A rotor assembly according to claim 1 wherein the keyway includes a plurality of angularly spaced, axially extending straps shaped such that, on forming the rotor, the material of which the rotor is formed extends radially behind the keys or straps in a manner such that the formed rotor is restrained against relative rotation on the hub and against radial separation from the hub.

4. A rotor assembly according to claim 1 wherein the keyway includes:

i) at least two axially spaced, circumferential rings which define at least one radially outwardly open slot therebetween, and ii) a plurality of angularly spaced, axially extending straps provided in the or each slot, wherein the rings and straps are shaped such that, on forming the rotor, the material of which the rotor is formed extends radially behind the keys and interlocks with the rings in a manner such that the formed rotor is restrained against relative rotation on the hub and against radial separation from the hub.

* * * * *